US010442658B2

(12) United States Patent
Sevigny

(10) Patent No.: US 10,442,658 B2
(45) Date of Patent: Oct. 15, 2019

(54) RETRACTABLE VACUUM HOSE REEL ASSEMBLY

(71) Applicant: DRAINVAC INTERNATIONAL 2006 INC., Mont-Saint-Hilaire (CA)

(72) Inventor: Martin Sevigny, Saint-Hyacinthe (CA)

(73) Assignee: DRAINVAC INTERNATIONAL 2006 INC., Mont-Saint-Hilaire (CA)

( * ) Notice: Subject to any disclaimer, the term of this patent is extended or adjusted under 35 U.S.C. 154(b) by 252 days.

(21) Appl. No.: 15/587,994

(22) Filed: May 5, 2017

(65) Prior Publication Data

US 2018/0319621 A1 Nov. 8, 2018

(51) Int. Cl.

| | |
|---|---|
| ***B65H 57/14*** | (2006.01) |
| ***B65H 75/48*** | (2006.01) |
| ***B65H 75/44*** | (2006.01) |

(52) U.S. Cl.

CPC ..... *B65H 75/486* (2013.01); *B65H 57/14* (2013.01); *B65H 75/4402* (2013.01); *B65H 75/446* (2013.01); *B65H 75/4434* (2013.01); *B65H 2701/33* (2013.01)

(58) Field of Classification Search

CPC B65H 75/446; B65H 75/486; B65H 75/4402; B65H 75/4434; B65H 57/14; B65H 2701/33

See application file for complete search history.

(56) References Cited

U.S. PATENT DOCUMENTS

| | | | | |
|---|---|---|---|---|
| 3,093,342 | A * | 6/1963 | Krohn | B65H 75/44 242/375 |
| 3,547,371 | A * | 12/1970 | Gruseck | B63B 35/816 242/377 |
| 4,154,324 | A * | 5/1979 | Upton | H02G 11/02 191/12.2 R |
| 4,224,960 | A * | 9/1980 | Nederman | B65H 75/4478 137/355.23 |
| 2006/0185953 | A1* | 8/2006 | Gieseke | B65H 75/486 191/12.2 R |

OTHER PUBLICATIONS

Nederman Holding AB, Vacuum Hose Reel 881 Ex, retrieved from www.nederman.com on May 28, 2019.

Nederman, Mounting Instruction—Spare part for Hose Reel Series 881, Document No. 148825/01; Jan. 30, 2007.

AB PH. Nederman & Co., Instruction Manual—Vacuum Hose Reel Series 881 EX, Jul. 6, 2018.

* cited by examiner

*Primary Examiner* — Sang K Kim

(74) *Attorney, Agent, or Firm* — BCF LLP

(57) ABSTRACT

A vacuum hose reel assembly has a spiral torsion spring. One end portion of the spiral torsion spring is received in a slot defined by a spring holder. As a vacuum hose is unwound from the reel, the spring is wound as the reel turns in a first direction. To wind the vacuum hose back on the reel, the spring unwinds and turns the reel in a second, opposite, direction. In the event that the forces between the end portion of the spring and the spring holder become too high, the end portion of the spring disengages the spring holder such that the end portion of the spring turns about the spring holder, thereby preventing the spring from breaking.

21 Claims, 15 Drawing Sheets

RETRACTABLE VACUUM HOSE REEL ASSEMBLY

FIELD OF TECHNOLOGY

The present technology relates to retractable vacuum hose reel assemblies.

BACKGROUND

Many industries, such as the automotive care industry, require the use of vacuum cleaners. Many such industries use portable vacuum cleaners that incorporate the vacuum motor and the waste container. A relatively short vacuum hose extends from the vacuum cleaner.

Although such portable vacuum cleaners are convenient and are relatively inexpensive, they have some draw backs. In order to clean different areas, the entire vacuum cleaner needs to be moved around. During and after use, the vacuum cleaner, the vacuum hose, the power cord of the vacuum cleaner and, if used, a power cord extension, are all possible tripping hazard. Also, in order to facilitate their displacement, the portable vacuum cleaners are often provided with swivelling wheels. However, this means that the vacuum cleaner could accidentally and damage objects in its environment. For example, a person cleaning the inside of a car could pull on the vacuum hose and, as a result, pull on the vacuum cleaner that could roll into the side of the car and damage it. Also, portable vacuum cleaners are noisy and, due to their relatively short vacuum hoses, the user is exposed to this noise.

In order to address at least some of the above drawbacks, many industries prefer to use central vacuum cleaners. The vacuum motor and the waste container of the central vacuum cleaner are typically installed in a fixed location that is remote from the area that needs to be vacuumed. As such, they are no longer a tripping hazard. A relatively long vacuum hose is connected to a vacuum outlet that communicates with the vacuum cleaner. As a result, handling is facilitated as the user only needs to carry around the vacuum hose. Also, since the vacuum motor is provided remotely, the user is less exposed or not exposed to its noise.

However, the long vacuum hoses used with central vacuums can still be tripping hazards. To address this problem, a vacuum hose reel assembly can be provided that allow the vacuum hose to be easily put away when not in use by winding the vacuum hose about the reel.

Some vacuum hose reel assemblies are retractable, meaning that the user does not need to manually turn the reel in order to wind the vacuum. As would be understood, this is very convenient to the user. In some implementations, the vacuum hose reel assembly includes a spring that is wound as the vacuum hose is unwound from the coil. When the user is done with the vacuum hose, the user releases the energy stored in the spring, by giving a quick tug on the vacuum hose or by some other means depending on the implementation, causing the spring to unwind and to turn the reel to wind the vacuum hose about the reel. However, in some such vacuum hose reel assemblies, the forces applied to the spring as it unwinds or when the reel comes to a sudden stop, may cause the spring to break. This is especially true when very long hoses are used since the force of the spring and the mass of the vacuum hose are greater. Also, the type of matter to be aspirated and a height at which the vacuum hose reel assembly is to be installed also have an effect on the forces that are applied to the spring. For example, aspirating water using a vacuum hose mounted to a vacuum hose reel mounted 7 meters high applies more forces on than aspirating dust using a vacuum hose mounted to a vacuum hose reel mounted 3 meters high. These forces could also potentially cause failure of the spring.

There is therefore a desire for a retractable vacuum hose reel using a spring assembly that addresses at least some of the above drawbacks.

SUMMARY

It is an object of the present technology to ameliorate at least some of the inconveniences present in the prior art.

According to an aspect of the present technology, there is provided a vacuum hose reel assembly that has a spiral torsion spring. One end portion of the spiral torsion spring is received in a slot defined by a spring holder. As the vacuum hose is unwound from the reel, the spring is wound as the reel turns in a first direction. To wind the vacuum hose back on the reel, the spring unwinds and turns the reel in a second, opposite, direction. In the event that the forces between the end portion of the spring and the spring holder become too high, the end portion of the spring disengages the spring holder such that the end portion of the spring turns about the spring holder, thereby preventing the spring from breaking. Unwinding the vacuum hose causes the end portion of the spring to reengage the spring holder.

According to one aspect of the present technology, there is provided a vacuum hose reel assembly having a rotationally fixed axle, a reel rotationally mounted to the axle, and a spring assembly operatively connected between the axle and the reel. The spring assembly is adapted for turning the reel in order to wind a vacuum hose on the reel. The spring assembly has a spring holder connected to and being rotationally fixed relative to the axle, and a spiral torsion spring. The spring holder has first and second walls. The first and second walls define a slot therebetween. The first wall extends radially further from a center of the axle than the second wall. The spring holder has an outer surface extending from a radially outer end of the first wall to a radially outer end of the second wall. The spiral torsion spring has an outer end portion operatively engaging the reel, and an inner end portion selectively operatively engaging the spring holder. The inner end portion being selectively received in the slot of the spring holder. When the reel turns in a first direction to unwind the vacuum hose from the reel, the inner end portion of the spiral torsion spring is disposed in the slot and abuts the first wall, and the spiral torsion spring is wound. When the spiral torsion spring turns the reel in a second direction, opposite the first direction, to wind the vacuum hose on the reel, the inner end portion of the spiral torsion spring is disposed in the slot and abuts the second wall, and the spiral torsion spring unwinds. When a force between the inner end portion of the spiral torsion spring and the second wall exceeds a predetermined force while the reel turns in the second direction, the inner end portion of the spiral torsion spring disengages the spring holder by coming out of the slot and then turns about the spring holder, and the inner end portion of the spiral torsion spring abuts the outer surface of the spring holder as the inner end portion turns over at least a portion of a rotation.

According to another aspect of the present technology, the outer surface of the spring holder has a shape of a segment of a spiral.

According to another aspect of the present technology, a radially inner end of the first wall of the spring holder is radially spaced from the axle. The spring holder has an inner surface extending from the radially inner end of the first wall away from the second wall. The inner surface is radially spaced from the axle. The inner surface of the spring holder and the axle define a space radially therebetween. The space communicates with the slot. When the inner end portion of the spiral torsion spring is disposed in the slot, the inner end portion of the spiral torsion spring is disposed in the space.

According to another aspect of the present technology, the inner end portion of the spiral torsion spring is hook-shaped.

According to another aspect of the present technology, the radially inner end of the first wall is radially further from the center of the axle than the radially outer end of the second wall.

According to another aspect of the present technology, a side of the reel defines a recess, and the spring assembly is disposed in the recess.

According to another aspect of the present technology, the spring assembly has a spring housing. The spiral torsion spring is disposed in the spring housing. The spring housing has an eccentric contour. The outer end portion of the spiral torsion spring is disposed in a portion of the spring housing defined by a portion of the eccentric contour being furthest from a central axis of the reel.

According to another aspect of the present technology, a ratchet assembly is operatively connected to the reel and selectively prevents turning of the reel to wind the vacuum hose.

According to another aspect of the present technology, the ratchet assembly and the spring assembly are disposed on opposite sides of the reel.

According to another aspect of the present technology, the ratchet assembly has a plate connected to a side of the reel. The plate defines a central aperture. The plate defines internal ratchet teeth over only a portion of a contour of the central aperture.

According to another aspect of the present technology, the axle is hollow. A first end of the axle is adapted for fluidly communicating with a vacuum cleaner. A second end of the axle is adapted for fluidly communicating with the vacuum hose.

According to another aspect of the present technology, the vacuum hose is provided and fluidly connects to the second end of the axle.

According to another aspect of the present technology, the vacuum hose extends from the second end of the axle outside the reel, extends through a side of the reel, and is selectively wound about the reel.

According to another aspect of the present technology, a seal assembly disposed over the second end of the axle. The vacuum hose is connected to the seal assembly.

According to another aspect of the present technology, the seal assembly is connected to and turns with the reel.

According to another aspect of the present technology, at least one fluid hose extends inside the axle and at least partially inside the vacuum hose.

According to another aspect of the present technology, the at least one fluid hose is one of at least one water hose and at least one pressurized air hose.

According to another aspect of the present technology, a guide assembly is connected to the axle. The guide assembly defines a guide passage. A hose stopper is connected to an end of the vacuum hose. The vacuum hose extends through the guide passage. The hose stopper is dimensioned so as to not pass through the guide passage.

According to another aspect of the present technology, a mounting bracket is connected to the axle. A guide assembly is connected to the mounting bracket in at least one of a first configuration and a second configuration. The guide assembly includes a guide adapted to receive the vacuum hose extending from the reel therethrough. In the first configuration the guide guides the vacuum hose generally horizontally. In the second configuration the guide guides the vacuum hose generally vertically.

According to another aspect of the present technology, at least one ball bearing is disposed between the axle and the reel for rotationally supporting the reel about the axle.

According to another aspect of the present technology, the at least one ball bearing is two ball bearings.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
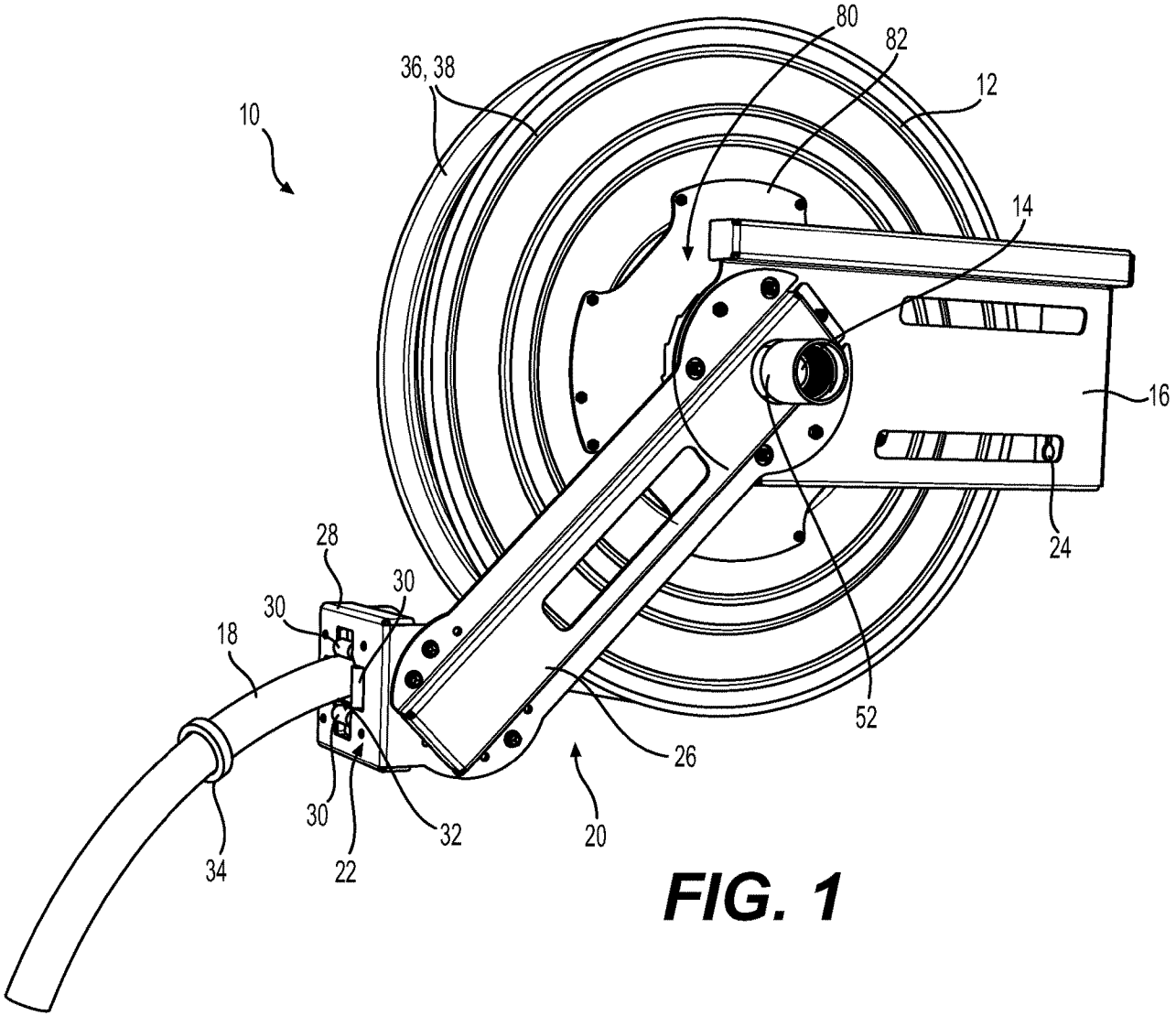
FIG. 1 is a perspective view take from a front, left side of a retractable vacuum hose reel assembly in a wall mounting configuration.

With reference to FIGS. 1 to 5, a vacuum hose reel assembly 10 has a reel 12 rotationally mounted on an axle 14. The axle 14 is connected to a mounting bracket 16. A vacuum hose 18 is wound about the reel 12. A guide assembly 20 is connected to the mounting bracket 16. The guide assembly 20 has a guide 22 through which the vacuum hose 18 extends, such that the guide 22 guides the vacuum hose 18 as it is being wound onto and unwound from the reel 12.

Figure 2:
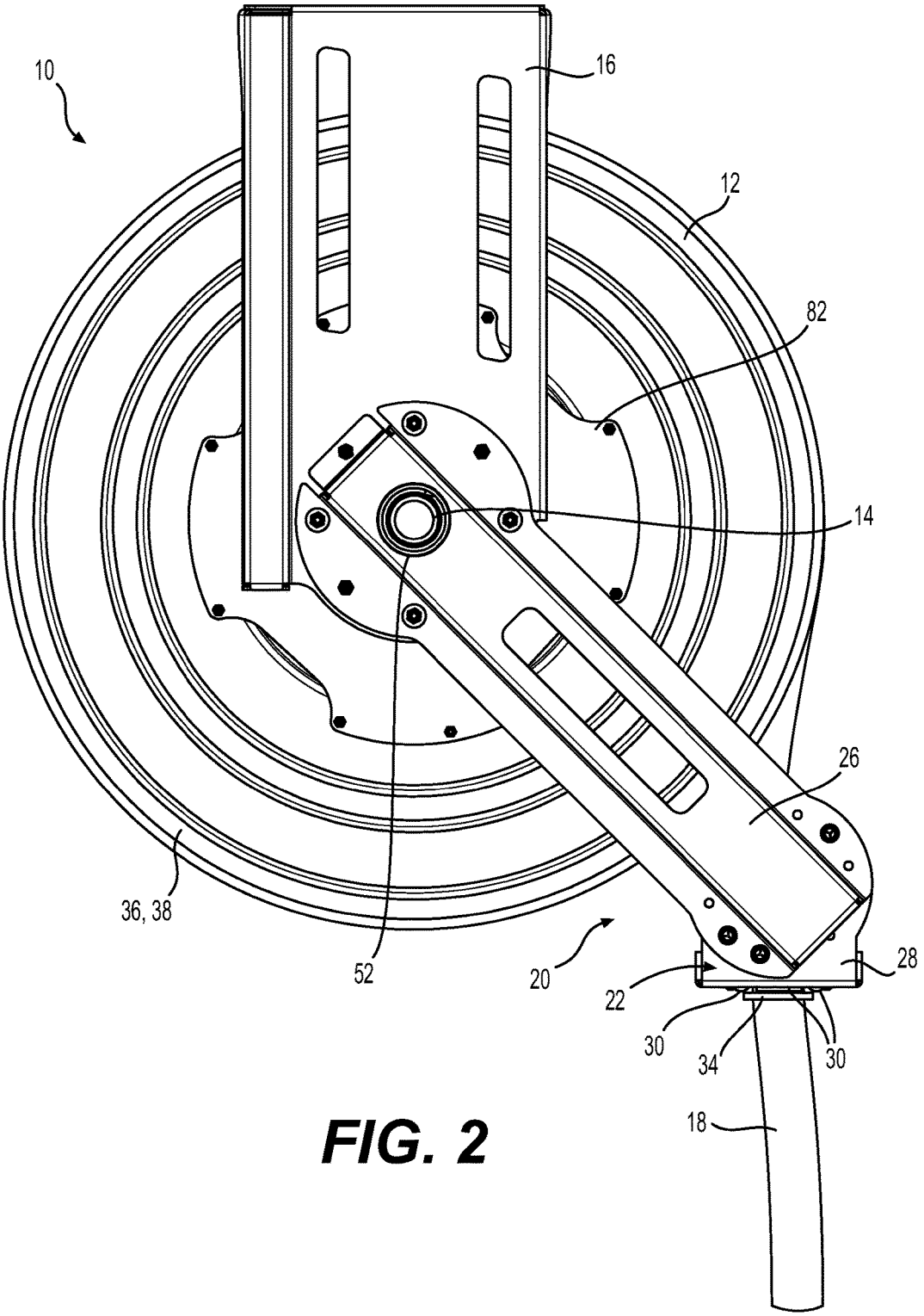
FIG. 2 is a left side elevation view of the retractable vacuum hose reel assembly of FIG. 1 in a ceiling mounting configuration.
Figure 3:
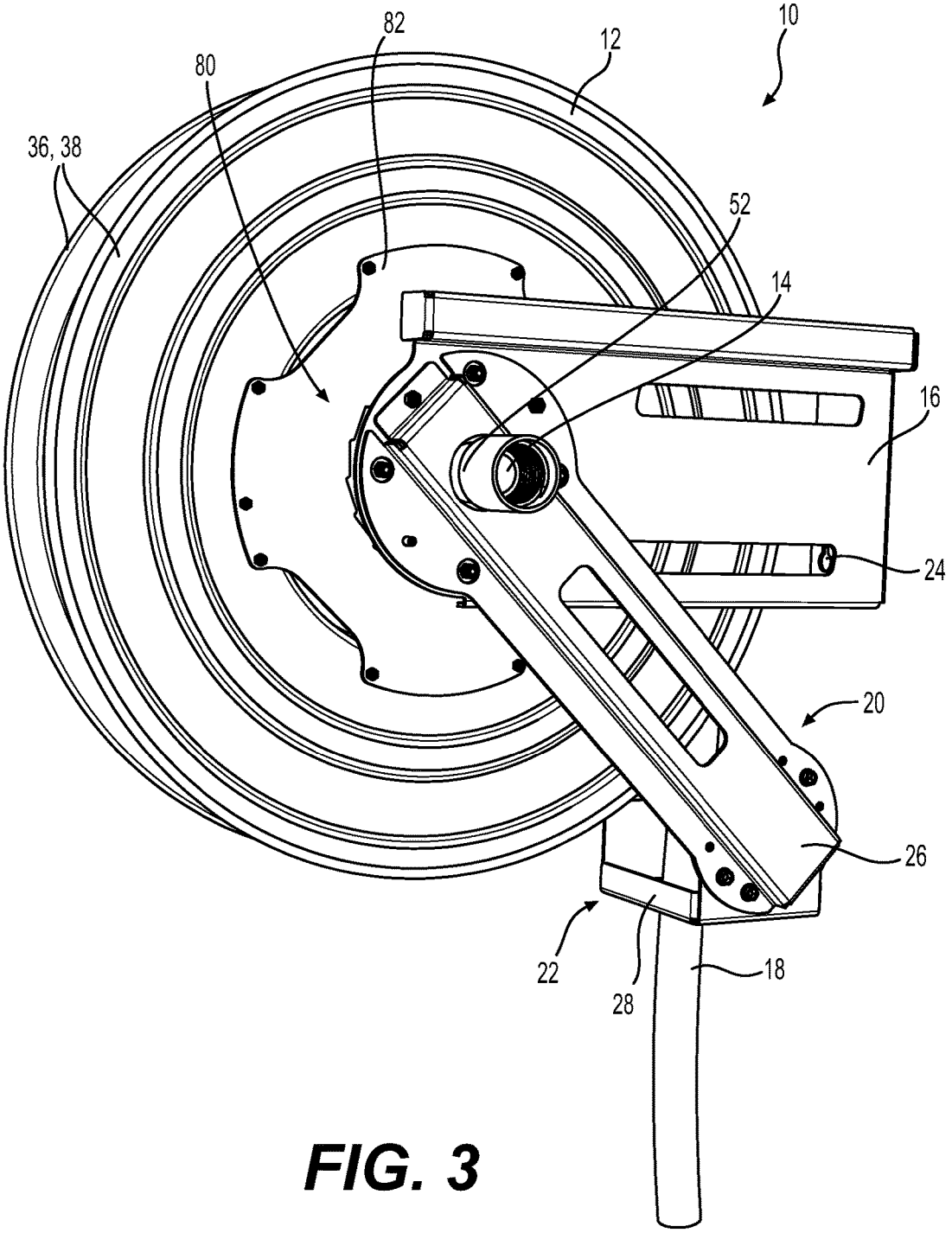
FIG. 3 is a perspective view take from a front, left side of the retractable vacuum hose reel assembly of FIG. 1 in an alternative wall mounting configuration.

The mounting bracket 16 is generally L-shaped. One side of the mounting bracket 16 defines a plurality of apertures 24 (only one of which can be seen in FIGS. 1 and 3). Fasteners (not shown), such as bolts, are inserted through the apertures 24 to fasten the mounting bracket 16, and therefore the vacuum hose reel assembly 10, to a mounting surface. The mounting bracket 16 can be used to mount the vacuum hose reel assembly 10 in a wall mounting configuration as shown in FIGS. 1 and 3 or in a ceiling mounting configuration as shown in FIG. 2. Although they are being referred to herein as wall and ceiling mounting configurations, it should be understood that these configurations are not intended to limit the mounting of the vacuum hose reel assembly 10 to a wall or to a ceiling. Rather, the wall mounting configuration is intended to indicate that the mounting bracket 16 can be mounted to a wall, but also to other vertically extending structures, such as a mast for example. Similarly, the ceiling mounting configuration is intended to indicate that the mounting bracket 16 can be mounted to a ceiling, but also to other horizontally extending structures, such as a beam for example. It is also contemplated that the mounting bracket 16 could be fastened that are not vertical or horizontal.

The guide assembly 20 has a guide arm 26 connected to the mounting bracket 16 at one end. The guide 22 is connected to the guide arm 26 at the opposite end of the guide arm. As can be seen in FIGS. 1 to 3, the guide assembly 20 can be arranged in multiple configurations. In the configuration illustrated in FIG. 1, the guide arm 26 is connected to the mounting bracket 16 so as to extend downward and forward from the mounting bracket 16 and the guide 22 is connected to the end of the guide arm 26 such that the vacuum hose 18 is guided generally horizontally by the guide 22. In the configuration illustrated in FIGS. 2 and 3, the guide arm 26 is connected to the mounting bracket 16 so as to extend downward and rearward from the mounting bracket 16 and the guide 22 is connected to the end of the guide arm 26 such that the vacuum hose 18 is guided generally vertically by the guide 22. Other configurations of the guide assembly 20 are contemplated. For example it is contemplated that in an alternative configuration not illustrated herein, the guide arm 26 is connected to the mounting bracket 16 so as to extend downward and forward from the mounting bracket 16 and the guide 22 is connected to the end of the guide arm 26 such that the vacuum hose 18 is guided generally vertically by the guide 22.

The configuration of the mounting bracket 16 and of the guide assembly 20 is selected based on the location where the vacuum hose reel assembly 10 is to be installed. For simplicity, the remainder of the description of the vacuum hose reel assembly 10 will be made with respect to the configuration of the mounting bracket 16 and of the guide assembly 20 illustrated in FIG. 1.

The guide 22 includes a roller housing 28. The roller housing 28 is fastened to the end of the guide arm 26. Four rollers 30 are mounted to the roller housing 28. The rollers 30 are arranged so as to form a generally square guide passage 32 therebetween. The vacuum hose 18 passes through the guide passage 32. The diameter of the vacuum hose 18 is smaller than the length of the sides of the guide passage 32 (i.e. the distance between opposed rollers). As the vacuum hose 18 passes through the guide passage 32 it comes into contact with one or more of the rollers 30 as the guide 22 guides the vacuum hose 18. It is contemplated that the rollers 30 could be omitted, but the presence of the rollers 30 help reduce wear of the vacuum hose 18 as it passes through the guide passage 32 and the forces required to unwind and winding the vacuum hose 18 as there is less friction. It is contemplated that more of less than four rollers 30 could be provided. For example, three rollers 30 could be arranged so as to form a generally triangular guide passage 32. It is also contemplated that the rollers 30 could be replaced by non-rolling sliders or a sleeve made of a low friction plastic or similar material.

Figure 4:
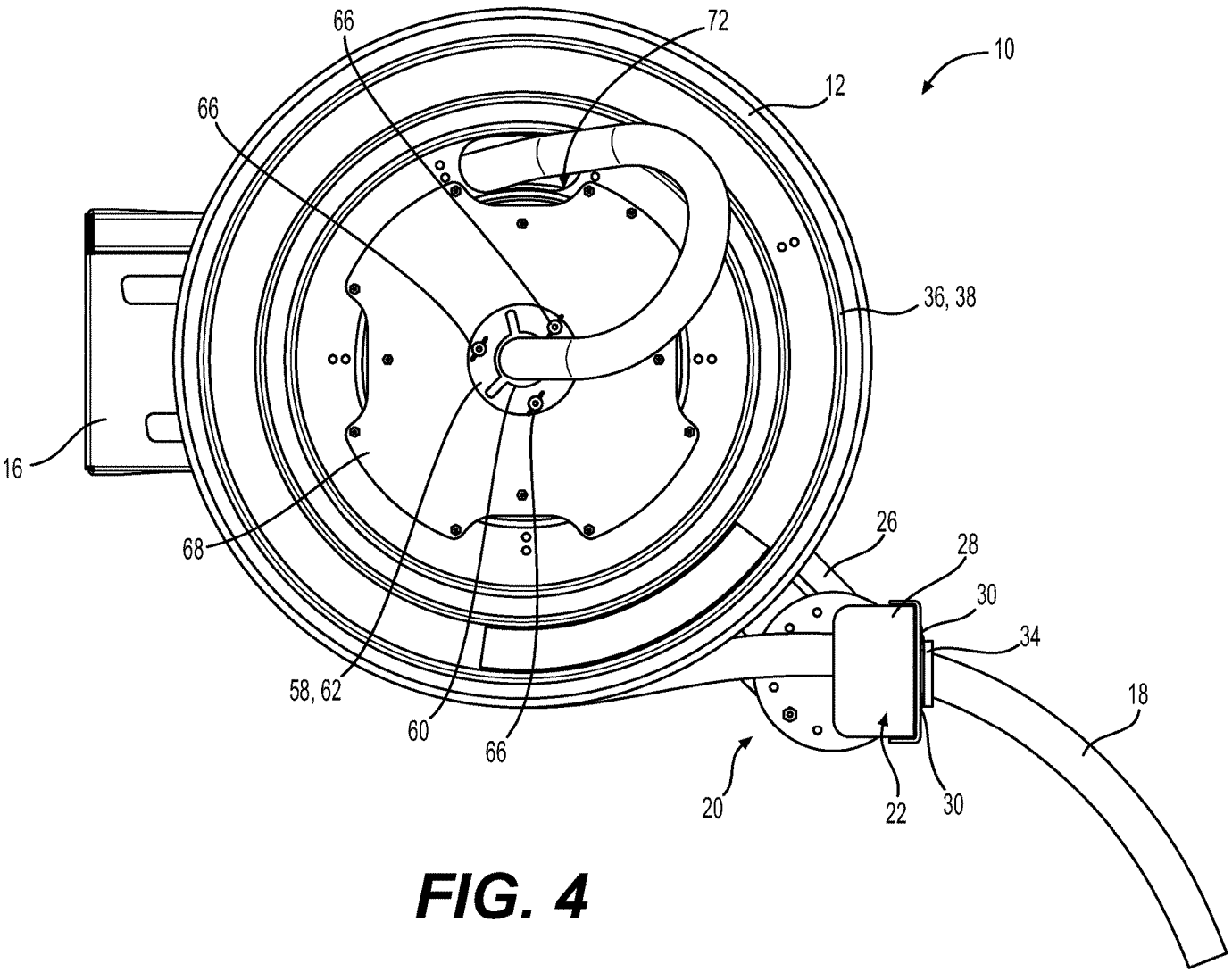
FIG. 4 is a right side elevation view of the retractable vacuum hose reel assembly of FIG. 1.

To stop the reel 12 from winding the vacuum hose 18 too far, which would then require the user to thread the vacuum hose 18 through the guide passage every time the user wants to use the vacuum hose, a stopper clip 34 is attached to the contour of the vacuum hose 18. The diameter of the stopper clip 34 is greater than the size of the guide passage 32. As such, as the vacuum hose 18 is wound on the reel 12, the stopper clip 34 will eventually come into contact with the rollers 30, as shown in FIG. 4, thereby preventing the vacuum hose 18 from winding any further on the reel 12. The stopper clip 34 can be located at any desired location along the vacuum hose 18, but it is typically located at a location on the vacuum hose 18 that will leave a length of vacuum hose 18 extending from the guide 22 that is sufficiently long to easily reach the vacuum hose 18 when the stopper clip 34 contacts the guide passage 32.

Figure 5:
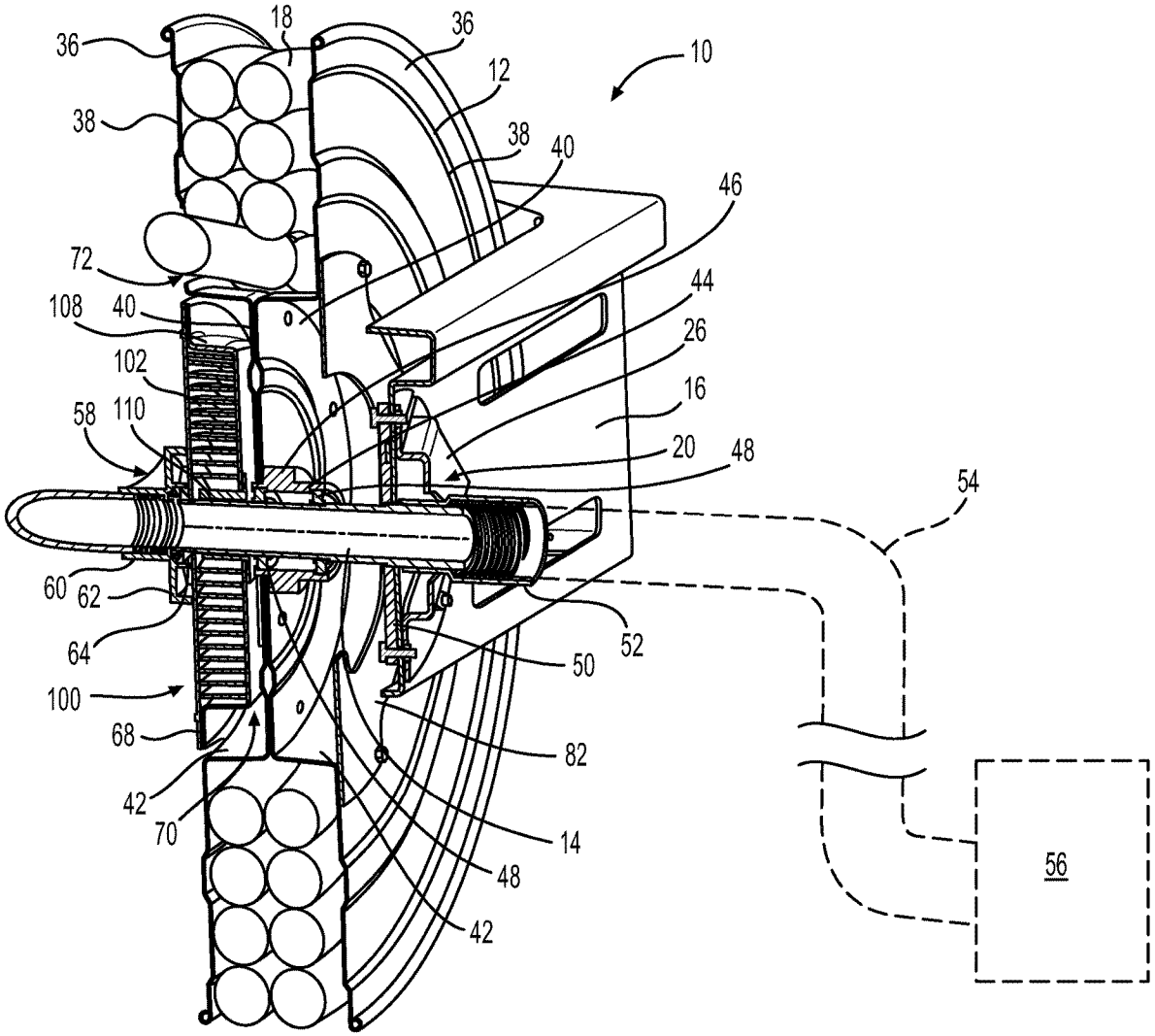
FIG. 5 is a cross-sectional view of the retractable vacuum hose reel assembly of FIG. 1 schematically illustrating a connection of the retractable vacuum hose reel assembly to a vacuum cleaner.

As can be seen in FIG. 5, the reel 12 is from two reel halves 36 that are fastened to each other. Each reel half 36 has a radially outer hose guide portion 38 and a central recessed portion 40. The central recessed portions 40 abut each other and are fastened to each other to form the reel 12. When the vacuum hose 18 is wound on the reel 12, as seen in FIG. 5, the vacuum hose 18 is disposed laterally between the hose guide portions 28 and rests on the portions 42 of the reel halves 36 joining each hose guide portion 38 to its corresponding central recessed portion 40.

Each reel half 36 defines a central aperture through which a sleeve 44, which forms part of the reel 12, is inserted. The sleeve 44 is connected to the reel halves 36 and extends on a left side of the central recessed portion 40 of the of the left reel half 36. The sleeve 44 defines an outer shoulder 46 that abuts the left side of the central recessed portion 40 of the of the left reel half 36. Two ball bearings 48 are disposed between the sleeve 44 and the axle 14 to rotationally mount the reel 12 to the axle 14, thus allowing the reel 12 to turn about the axle 14. It is contemplated that only one or more than two ball bearings 48 could be provided.

The left end portion of the axle 14 extends through apertures defined in a plate 50, the mounting bracket 16 and the guide arm 16. As can be seen in FIG. 5, the plate 50 is fastened to the mounting bracket 16. The axle 14 is connected to the plate 50 so as to be rotationally fixed. As can be seen, the axle 14 is hollow. A vacuum hose connector 52 is provided over the left end portion of the axle 14. The vacuum hose connector 52 has internal threads. A vacuum hose 54 is threaded into the vacuum hose connector 52 at one end and is connected to a vacuum cleaner 56 (schematically shown in FIG. 5) at the other end. The vacuum hose 54 has an internal diameter that is bigger than the internal diameters of the vacuum hose 18 and the axle 14, but it is contemplated that it could be the same. It is contemplated that vacuum hose connector 52 and the vacuum hose 54 could be replaced by a pipe connector and one or more rigid pipes to fluidly connected the axle 14 to the vacuum cleaner 56. It is also contemplated that a combination of vacuum hose(s) and rigid pipe(s) could be used to fluidly connected the axle 14 to the vacuum cleaner 56.

As can be seen in FIG. 5, a seal assembly 58 is provided over the right end portion of the axle 14. The seal assembly 58 includes a sleeve 60, a mounting flange 62 and a lip seal 64. In the present implementation, the sleeve and the mounting flange 62 are integrally formed, but it is contemplated that they could be connected to each other otherwise. The sleeve 60 has internal threads that are engaged by outer threads formed on the end of the vacuum hose 18, thereby connecting the vacuum hose 18 to the seal assembly 58. The lip seal 64 is in contact with the contour of axle 14. The lip seal 64 preventing outside air from entering the passage provided inside the axle 14 via the interface between the ends of the vacuum hose 18 and the axle 14 when the vacuum cleaner 56 is in operation, which would reduce the efficiency of the vacuum cleaner 56. In fact, during operation of the vacuum cleaner 56, the pressure inside the vacuum hose 18 and the axle 14 is lower than the ambient pressure, thus pressing the lip seal 64 against the contour of the axle 14, thereby improving the seal provided by the lip seal 64. As best seen in FIG. 4, the mounting flange 62 is fastened by three butterfly fasteners 66 to a cover 68. The use of butterfly fasteners 66 allow the mounting and removal of the seal assembly 58 without the use of tools. It is contemplated that more or less than three fasteners 66 could be used and that the butterfly fasteners 66 could be replaced by another type of fastener. The cover 68 is provided over the recess 70 defined by the central recessed portion 40 of the right reel half 36. The cover 68 is fastened to the hose guide portion 38 of the right reel half 36. As a result, the cover 68, the seal assembly 58 and the vacuum hose 18 turn together relative to the axle 14. It is contemplated that the seal assembly 58 could be replaced by a different type of seal assembly.

From the seal assembly 58, the vacuum hose 18 passes through an aperture 72 (FIG. 4) defined in the hose guide portion 38 of the right reel half 36 of the reel 12 and is wound about the reel 12

During use of the vacuum cleaner 56, dirt, debris, liquid and/or any other thing aspirated flows consecutively through the vacuum hose 18, the axle 14 and the vacuum hose 54 before reaching the vacuum cleaner 56.

Figure 6:
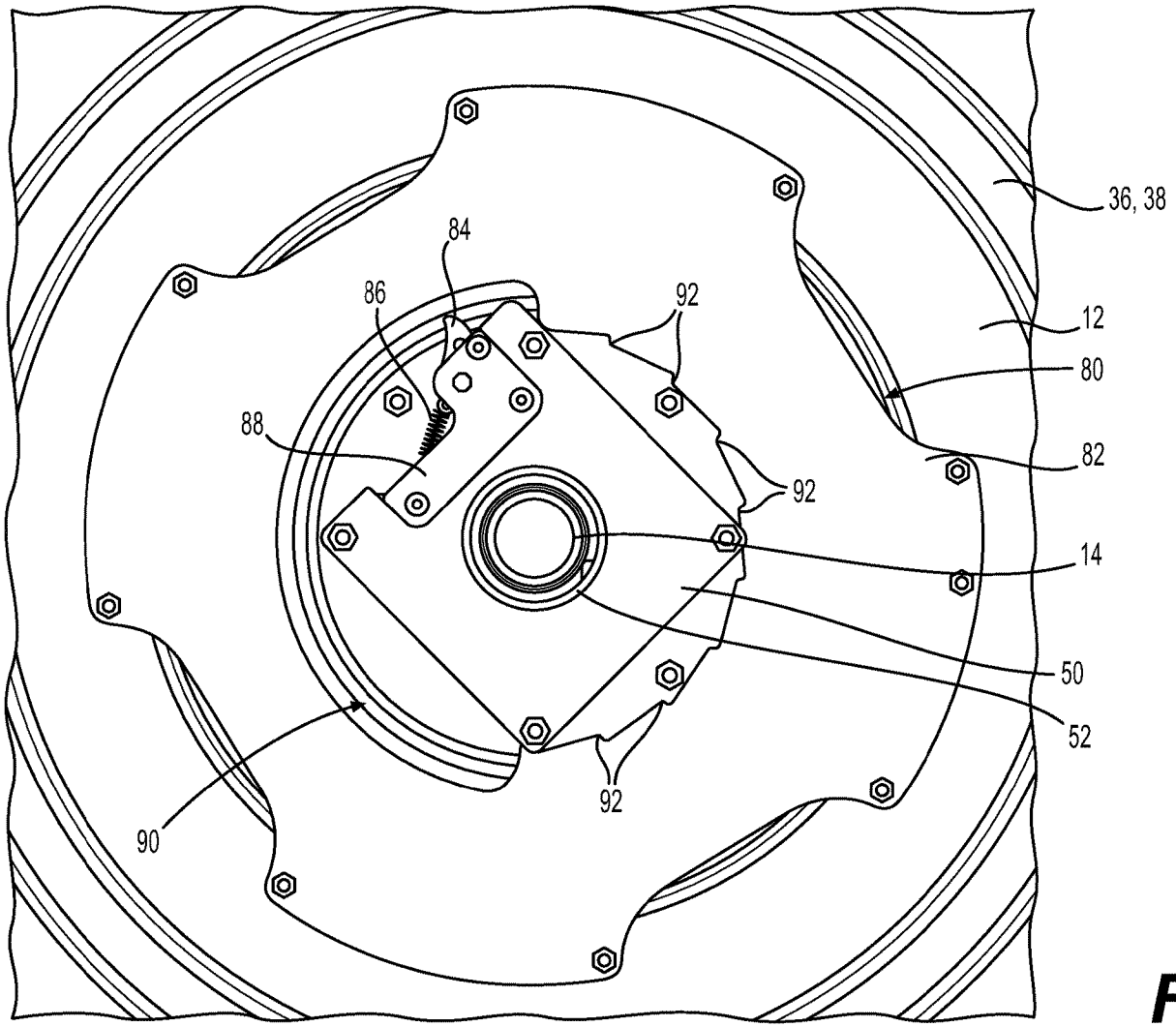
FIG. 6 is a close-up view of a left side of the retractable vacuum hose reel assembly of FIG. 1 with some components removed for showing a ratchet assembly of the retractable vacuum hose reel assembly.
Figure 7:
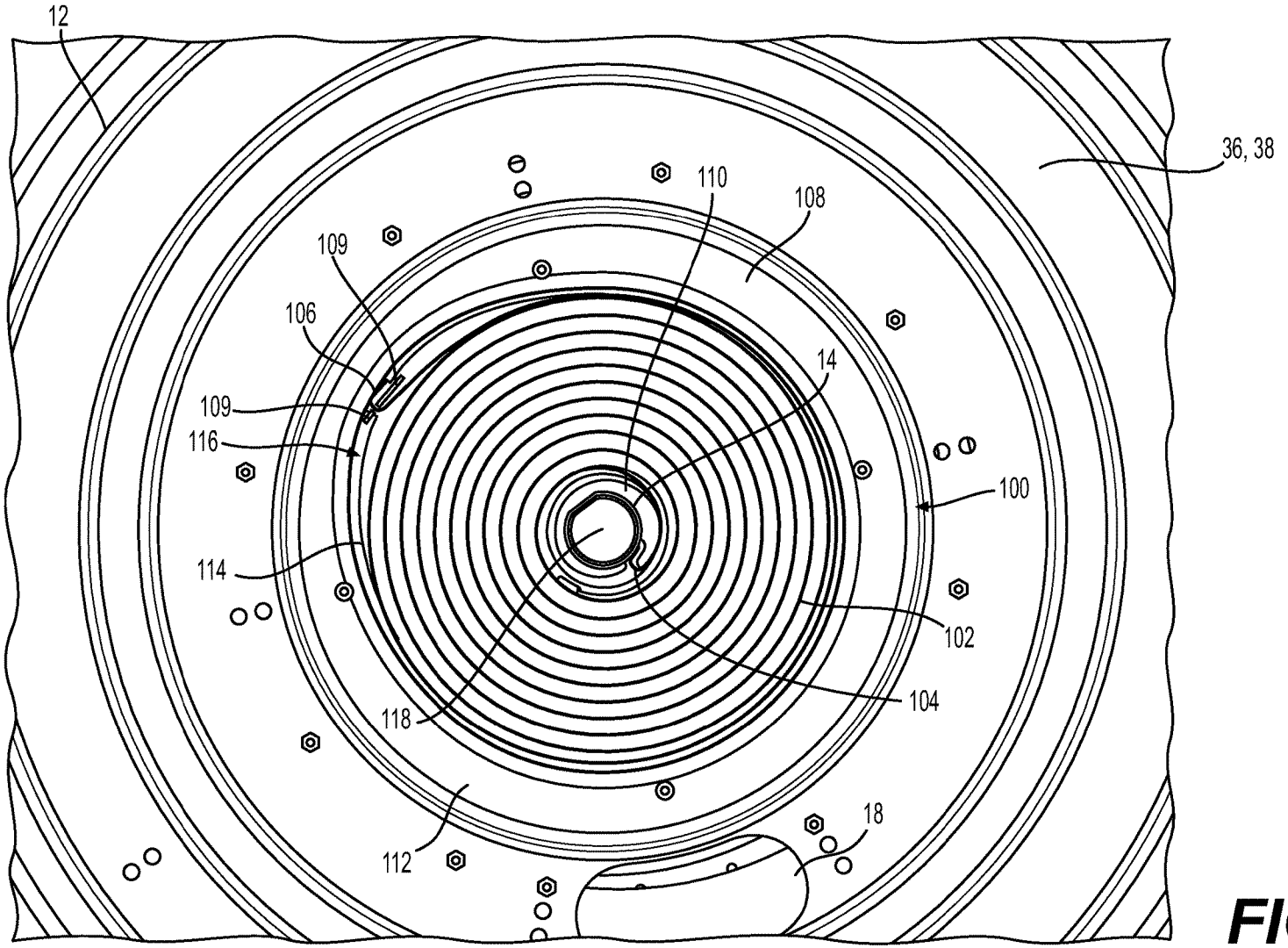
FIG. 7 is a close-up view of a right side of the reel of the retractable vacuum hose reel assembly of FIG. 1 with some components removed for showing a spring assembly of the retractable vacuum hose reel assembly.

The vacuum hose reel assembly 10 is provided with a ratchet assembly 80 (FIG. 6) and a spring assembly 100 (FIG. 7). The ratchet assembly 80 is provided on a left side of the reel 12 and the spring assembly 100 is provided on a right side of the reel 12. It is contemplated that the ratchet assembly 80 could be provided on a right side of the reel 12 and that the spring assembly 100 could be provided on a left side of the reel 12. It is also contemplated that in some implementations, the ratchet assembly 80 and the spring assembly 100 could be provided on the same side of the reel 12.

The functions of the ratchet assembly 80 and the spring assembly 100 will now be described. Details regarding the construction of the ratchet assembly 80 and the spring assembly 100 will be provided further below.

As a user pulls on the vacuum hose 18 to unwind from the reel 12, the reel 12 turns clockwise (as viewed from the left side of the vacuum hose reel assembly 10 in the configuration shown in FIG. 1). As the reel 12 turns clockwise, a spring 102 of the spring assembly 100 is wound. When the user stops pulling on the vacuum hose 18, the ratchet assembly 80 prevents the reel 12 from starting to turn counter-clockwise (as viewed from the left side of the vacuum hose reel assembly 10 in the configuration shown in FIG. 1) by the force applied to the reel 12 by the spring 102. Thus, the ratchet assembly 80 prevents the vacuum hose 18 from being wound back on the reel 12 when the user stops pulling on the vacuum hose 18. As would be understood, when the user stops pulling on the vacuum hose 18, the reel 12 will turn slightly due to backlash resulting from the design of the ratchet assembly 80 and the vacuum hose 18 will therefore retract slightly, but the reel 12 will not complete a full revolution or more.

In order to wind the vacuum hose 18 back on the reel 12, the user tugs on the vacuum hose 18 and then releases the vacuum hose 18 causing the ratchet assembly 80 to disengage thus allowing the energy stored in the spring 102 to turn the reel 12 counter-clockwise (as viewed from the left side of the vacuum hose reel assembly 10 in the configuration shown in FIG. 1). As the reel 12 turns counter-clockwise, the vacuum hose 18 is wound back on the reel 12. It is contemplated that alternative implementations of the ratchet assembly 80 could be disengaged by actuating a mechanical device such as a release lever rather than by tugging on the vacuum hose 18. It is also contemplated that the ratchet assembly 80 could be replaced by another type of mechanism for selectively preventing the vacuum hose 18 from winding back on the reel 12.

Turning now to FIG. 6, the ratchet assembly 80 will be described in more detail. The ratchet assembly 80 includes a plate 82, a pawl 84, a spring 86 and a mounting member 88. The plate 82 is fastened to the hose guide portion 38 of the left reel half 36. The plate 82 defines a central aperture 90. A plurality of internal ratchet teeth 92 (only some how which are labeled for clarity in the Figures) are defined over half of the contour of the aperture 90. It is contemplated that ratchet teeth 92 could provided over more or less than half of the contour of the aperture 90. It is also contemplated that more or less ratchet teeth 92 than illustrated could be provided. The distance between each ratchet teeth 92 determines the amount of backlash of the ratchet assembly 80. The pawl 84 is pivotally connected to the mounting member 88. The pawl 84, as can be seen in FIG. 6, has a convex side and a concave side that meet at a tip of the pawl 84. In one implementation, the pawl 84 is made from a material that is harder than the ratchet teeth 92. In one implementation, the pawl 84 is made from hardened steel, but other materials are contemplated. The spring 86 is connected between the pawl 84 and the mounting member 88. The spring 86 biases the pawl 84 against the portion of the contour of the aperture 90 defining the ratchet teeth 92 when the ratchet assembly 80 is operating to prevent turning of the reel 12 to wind the vacuum hose 18 (i.e. not when the use tugs on the vacuum hose 18 to disengage the ratchet assembly 80 as described above). The mounting member 88 is received in a channel formed in the plate 50 and is fastened to the mounting bracket 16.

When the user has unwound the vacuum hose 18 from the reel 12 to the desired length and stops pulling on the vacuum hose 18, the spring 102 causes the reel 12 to turn slightly (counter-clockwise with reference to FIG. 6) until the pawl 84, helped by the bias of the spring 86, engages a ratchet tooth 92. The ratchet assembly 80 is designed such that when the pawl 84 engages a ratchet tooth 92, the contact between the two parts generates a clicking noise that is loud enough to be heard by the user, thus giving the user an audible feedback that the pawl 84 has engaged the ratchet tooth 92. It is contemplated that this audible feedback feature could be omitted. Once this occurs, the reel 12 is prevented from turning any further in this direction. However, pawl 84 will not prevent the vacuum hose 18 from being unwound further and the reel 12 from turning in the corresponding direction (i.e. clockwise with reference to FIG. 6). When the user tugs on the vacuum hose 18 and then releases the vacuum hose 18, the sudden pull and release cause the pawl 84 to pivot such that it no longer engages the ratchet teeth 92 as the reel 12 turns (counter-clockwise with reference to FIG. 6) under the action of the spring 102 to wind the vacuum hose 18 on the reel 12.

Turning now to FIGS. 5 and 7, the spring assembly 100 will be described in more detail. As can be seen in FIG. 5, the spring assembly 100 is disposed in the recess 70 defined by the central recessed portion 40 of the right reel half 36. As described above, the spring assembly 100 includes a spring 102. The spring 102 is a spiral torsion spring 102, sometimes referred to as a clock spring, and hereinafter referred to simply as the spring 102. The inner end portion 104 and the outer end portion 106 of the spring 102 are hook-shaped, but it is contemplated that they could be bent into other shapes.

The spring assembly 100 also includes a spring housing 108 and a spring holder 110. The spring 102 is disposed in the spring housing 108. The spring housing 108 is fastened to and abuts the cover 68 such that the spring 102 is held between the cover 68 and the spring housing 108. The spring housing 108 turns together with the reel 12. The outer end portion 106 of the spring 102 is held between a pair of tabs 109 (FIG. 7) extending from the cover 68 into the spring housing 108. In one implementation, the tabs 109 are integrally formed with and bent from the cover 68. The spring holder 110 is disposed over the axle 14 and is connected to the axle 14 so as to be rotationally fixed relative to the axle 14. The inner end portion 104 of the spring 102 selectively engages the spring holder 110 as will be described in more detail below. Since the spring holder 110 is rotationally fixed relative to the axle 14 but the spring housing 108 turns with the reel 12, when the reel 12 turns to unwind the vacuum hose 108, the spring 102 is wound. When the ratchet assembly 80 is disengaged, the spring 102 unwinds, the outer end portion 106 of the spring 102 pushes on the spring housing 106 which transfers the force to the reel 12 causing the reel 12 to turn to wind the vacuum hose 108 on the reel 12.

As can be seen in FIG. 7, the spring housing 108 has a flange 112 used for fastening the spring housing 108 to the cover 68. The spring housing 108 also has an eccentric contour 114 along the radially inner edge of the flange 112. The outer end portion 106 of the spring 102 is disposed in the portion 116 of the spring housing 108 defined by the portion of the contour 114 that is furthest from the central axis 118 of the reel 12. It should be noted that the central axis of the axle 14 is coaxial with the central axis 118 of the reel 12.

Turning now to FIGS. 8 to 11C, the spring holder 110 will be described in more detail. The spring holder 110 has a spring holder body 120 and a flange 122 connected to an end of the spring holder body 120. In the present implementation the spring holder body 120 and the flange 122 are integrally formed, but it is contemplated that they could be connected by other means, such as by welding or with fasteners. The spring holder 110 defines a central aperture 124. The axle 14 is inserted in this aperture 124. As can be seen in FIG. 5, the spring holder 110 is located on the axle 14 such that the flange 122 is located outside the spring housing 108 and the spring holder body 120 is disposed inside the spring housing 108. The contour of the central aperture 124 has a flat side 126. This flat side 126 is disposed over a corresponding flat side on an outer surface of the axle 14 (see FIG. 7), thus preventing the spring holder 110 from rotating relative to the axle 14. It is contemplated that other means could be provided for preventing the spring holder 110 from rotating relative to the axle 14 such as keys or splines, or by fastening or welding the spring holder 110 to the axle 14. It is also contemplated that the spring holder 110 could be integrally formed with the axle 14.

Figure 9:
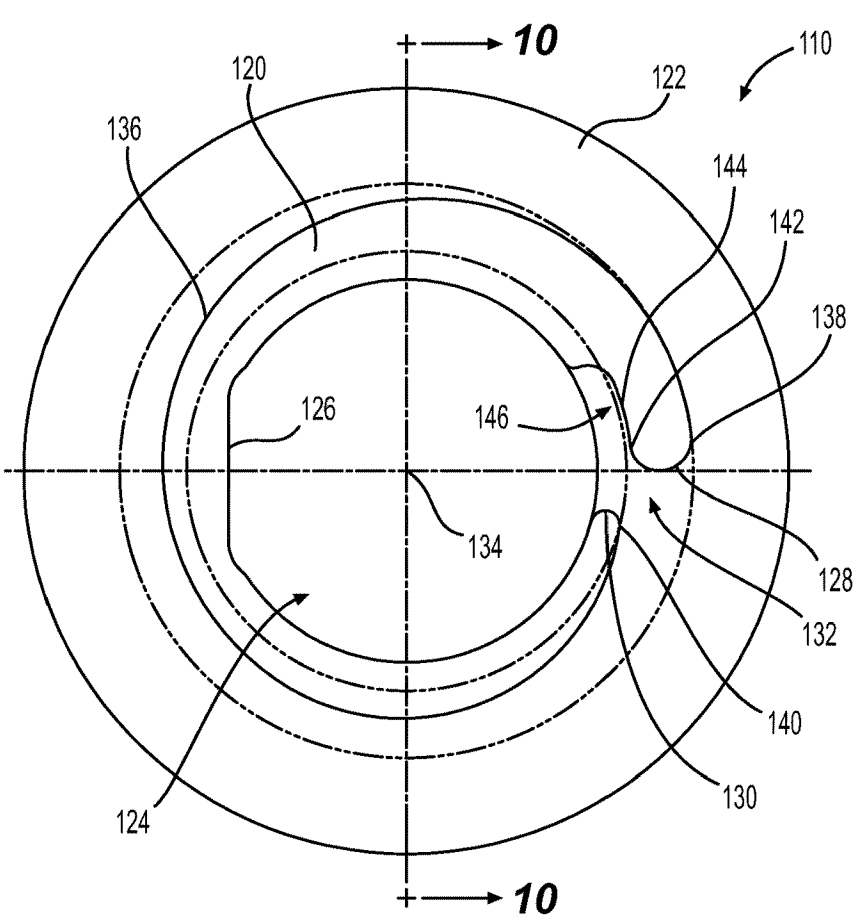
FIG. 9 is a right side elevation view of the spring holder of FIG. 8.
Figure 8:
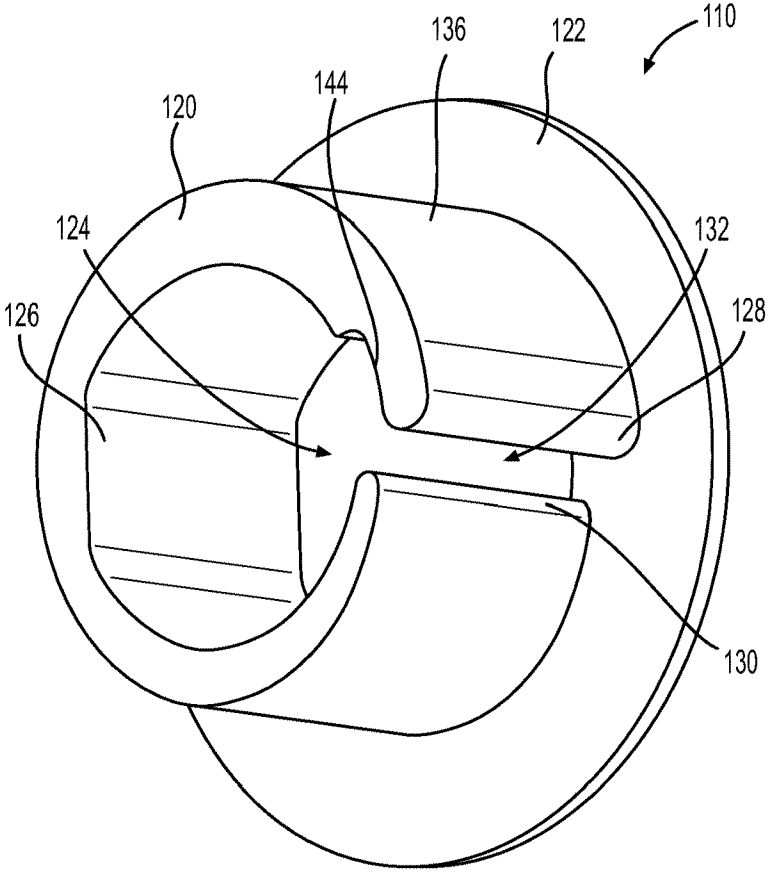
FIG. 8 is a perspective view of a spring holder of the retractable vacuum hose reel assembly of FIG. 1.

The spring holder body 120 has two end walls 128, 130 that define a slot 132 therebetween. The end walls 128, 130 are arcuate in the present implementation, but it is contemplated that they could have other shapes, including flat. The end walls 128, 130 are radially offset from each other. As best seen in FIG. 9, the end wall 128 is radially further from the center of the axle 14 (i.e. axis 118 in the Figures). than the end wall 130. In the present implementation, the center of the axle 14 corresponds to the center 134 of the spring holder 110. As such, the outer surface 136 of the spring holder body 120 that extends between the radially outer ends 138, 140 of the end walls 128, 130 respectively is not circular. The outer surface 136 has the shape of a segment of a spiral.

Also, the radially inner end 142 of the end wall 128 is radially further from the center 134 than the radially outer end 140 of the end wall 130. As a result, the radially inner end 136 is radially spaced from the axle 14. The spring holder body 120 has an inner surface 144 extending from the radially inner end 142 of the end wall 128 away from the end wall 130. The inner surface 144 is also radially spaced from the axle 14 so as to define a space 146 radially between the inner surface 144 and the axle 14. The space 146 and the slot 132 communicate with each other. In an alternative implementation, the radially inner end 142 of the end wall 128 is not spaced from the axle 14 and the space 146 is omitted.

Figure 11A:
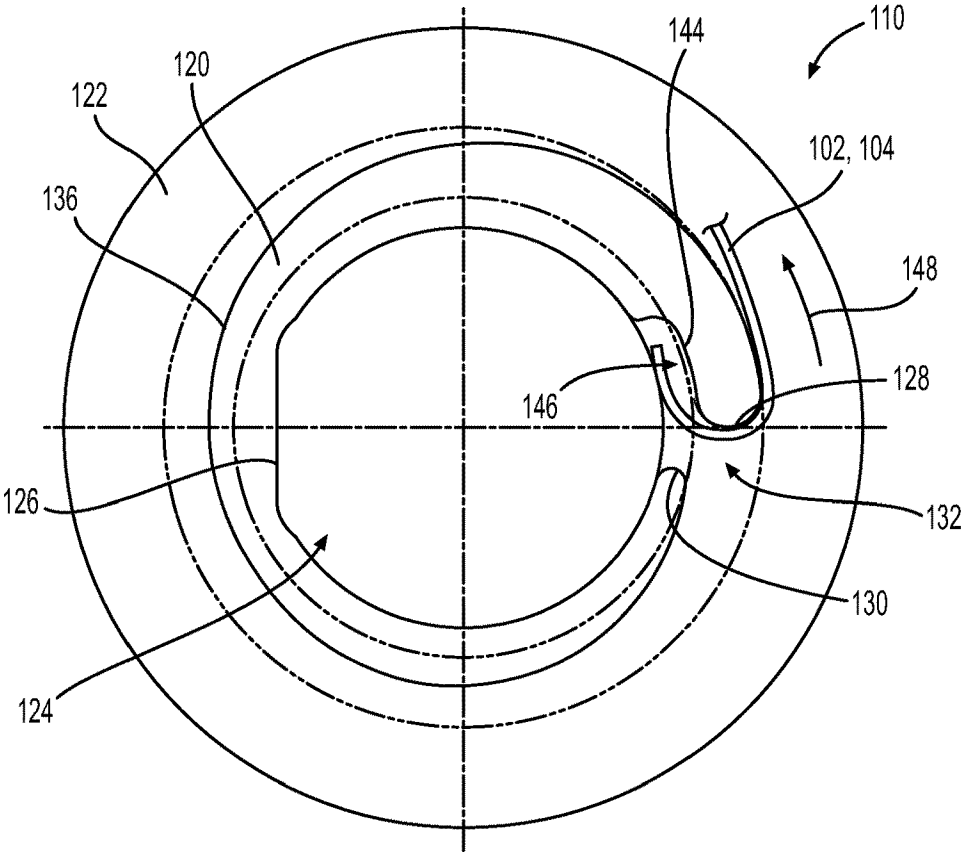
FIG. 11A is a right side elevation view of the spring holder of FIG. 8 and an end portion of the spring of the spring assembly of FIG. 7 during unwinding of a vacuum hose of the retractable vacuum hose reel assembly of FIG. 1.
Figure 10:
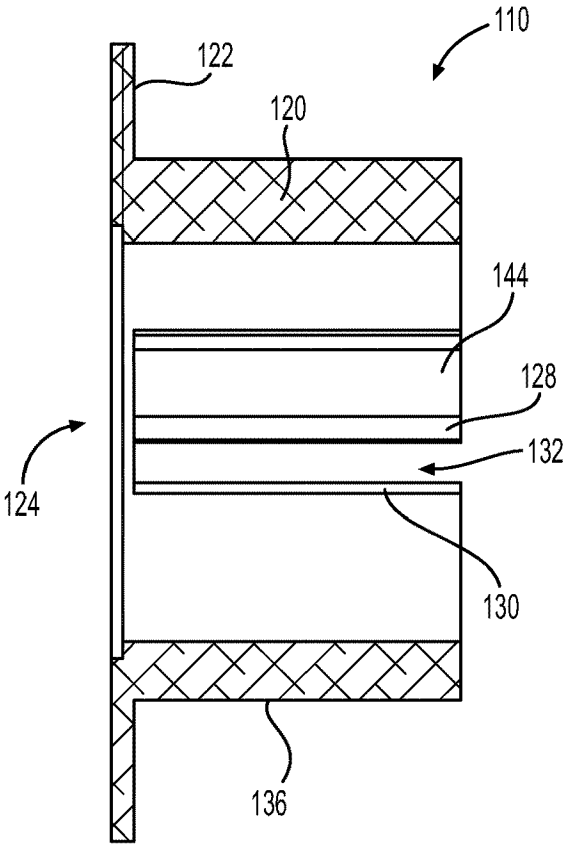
FIG. 10 is a cross-sectional view of the spring holder of FIG. 8 taken through line 10-10 of FIG. 9.
Figure 11C:
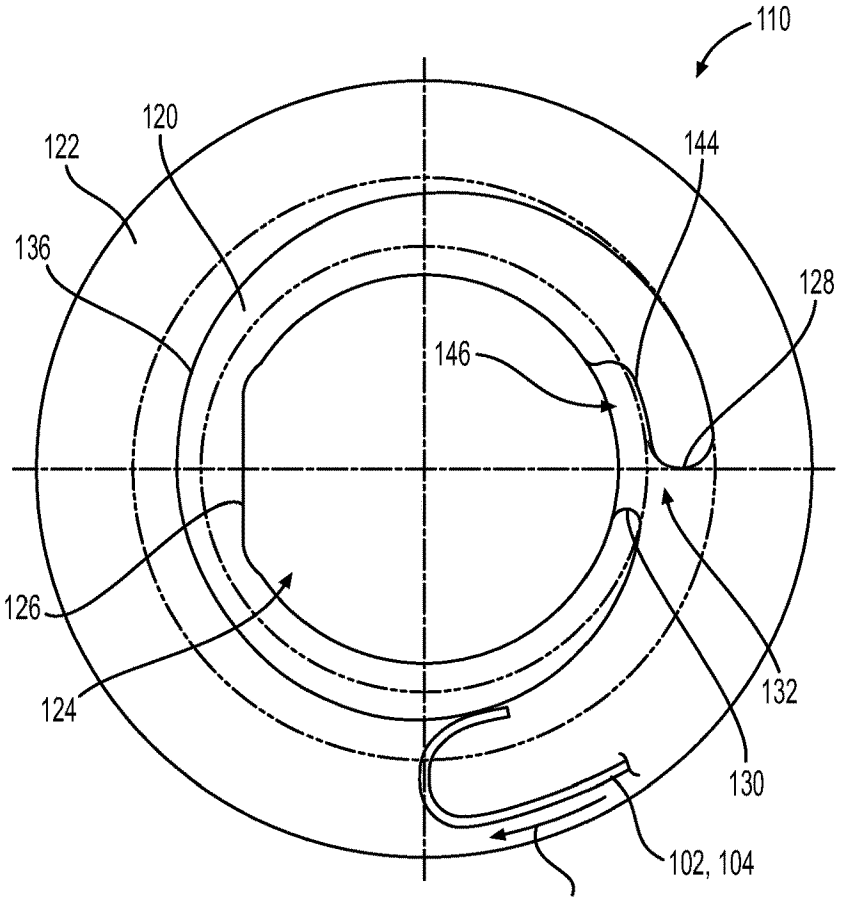
FIG. 11C is a right side elevation view of the spring holder and the end portion of the spring of FIG. 11A during winding of the vacuum hose when a force between the end portion of the spring and the spring holder becomes too high.
Figure 11B:
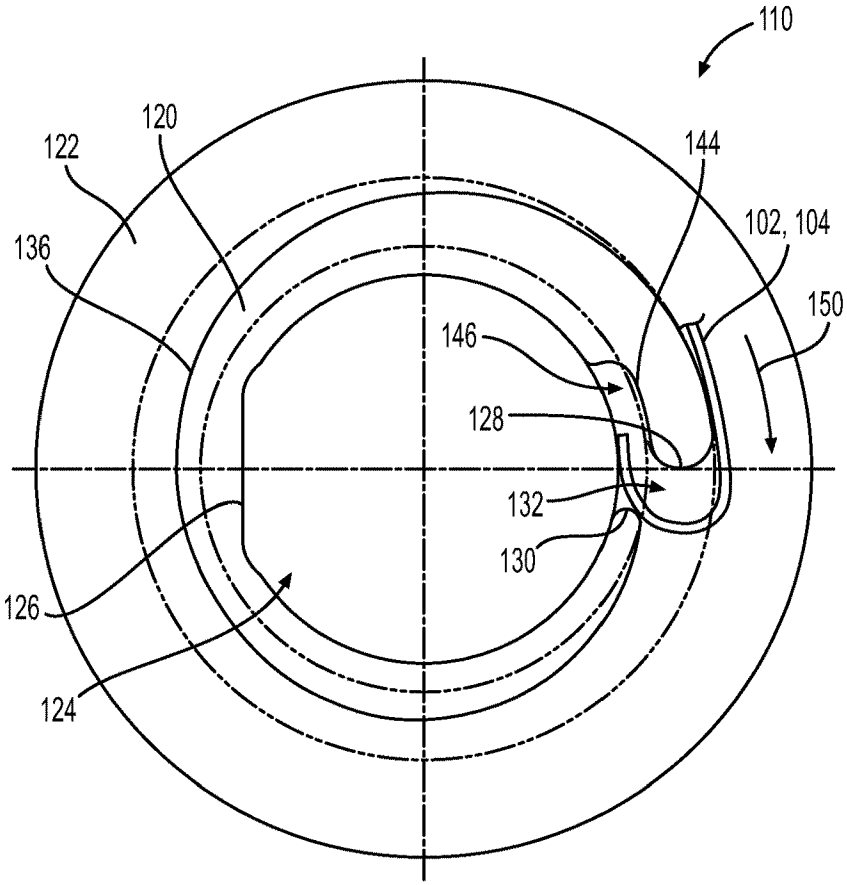
FIG. 11B is a right side elevation view of the spring holder and the end portion of the spring of FIG. 11A during winding of the vacuum hose with a reel of the retractable vacuum hose reel assembly of FIG. 1 turning slower than a predetermined speed.
Figure 12:
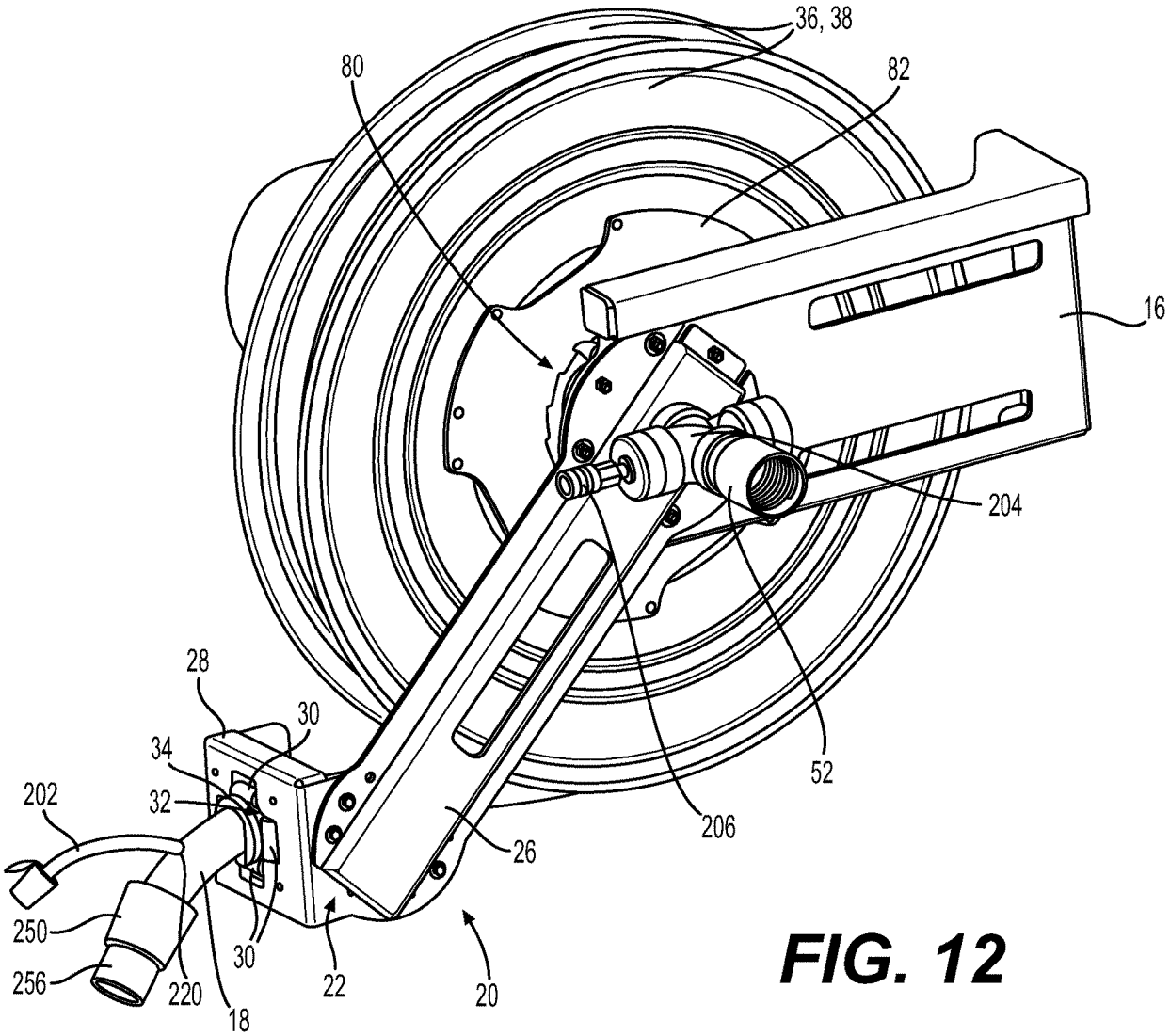
FIG. 12 is a perspective view take from a front, left side of an alternative implementation of the retractable vacuum hose reel assembly of FIG. 1 including a fluid hose.

The inner end portion 104 of the spring 102 is normally received in the slot 132 and the space 146 as shown in FIGS. 11A and 11B. With reference to FIG. 11A, when the user pulls on the vacuum hose 18 to unwind the vacuum hose 18 from the reel 12, the reel 12 turns in the direction indicated by the arrow 148, the inner end portion 104 of the spring 102 abuts the end wall 128, and the spring 102 is wound. With reference to FIG. 11B, when the ratchet assembly 80 is disengaged and the spring 102 turns the reel 12 in the direction indicated by arrow 150 to wind the vacuum hose 18 on the reel 12, the inner end portion 104 of spring 102 abuts the end wall 130, and the spring 102 unwinds. With reference to FIG. 11C, when a force between the inner end portion 104 of the spring 102 and the end wall 130 becomes too high (i.e. it exceeds a force predetermined by the design of the spring assembly 100) while the reel 12 turns in the direction indicated by arrow 150 (see FIG. 11B), the inner end portion 104 of the spring 102 disengages the spring holder 110 by coming out of the slot 132 and the space 146. The inner end portion 104 of the spring 102 then starts turning freely about the spring holder body 120 in the direction indicated by arrow 152 in FIG. 11C (i.e. the direction in which the reel 12 turns). The inner end portion 104 of the spring 102 abuts the outer surface 136 as it turns about the spring holder body 120. It is contemplated that the inner end portion 104 of the spring 102 could abut the outer surface 136 as it turns about the spring holder body 120 for only part of a rotation. By having the end portion 104 of the spring 102 disengage the spring holder 110 when the forces between the spring holder 110 and the end portion 104 of the spring 102 become too high, damage to the spring 102 and possible complete failure of the spring 102 are prevented. This could occur while the vacuum hose 18 is being wound. This could also occur should a user turn the reel 12 in the hose winding direction when the spring 102 is already in its normal, unwound configuration, which would otherwise cause the spring 102 to be unwound further than it was designed to be. Once the end portion 104 of the spring 102 is disengaged from the spring holder 110 as shown in FIG. 11C, turning the reel 12 in the direction opposite to the direction indicated by the arrow 152 in FIG. 11C causes the end portion 104 of the spring 102 to move toward the end wall 128. When the end portion 104 of the spring 102 reaches the end wall 128, it catches on the end wall 128 and returns to the position shown in FIG. 11A.

Turning now to FIGS. 12 to 15, a vacuum hose reel assembly 200 will now be described. The vacuum hose reel assembly 200 is an alternative implementation of the vacuum hose reel assembly 10 described above. For simplicity, the components of the vacuum hose reel assembly 200 corresponding to those of the vacuum hose reel assembly 10 have been labeled with the same reference numerals in the Figures and will not be described again in detail herein.

In the vacuum hose reel assembly 200, a fluid hose 202 is routed inside the vacuum hose 18. As a result, the user can conveniently wind and unwind the vacuum hose 18 and the fluid hose 202 simultaneously on the same reel 12. In on implementation, the fluid hose 202 is a water hose to supply water that may or may not be pressurized. In another implementation, the fluid hose 202 is a pressurized air hose to supply pressurized air.

Figure 13:
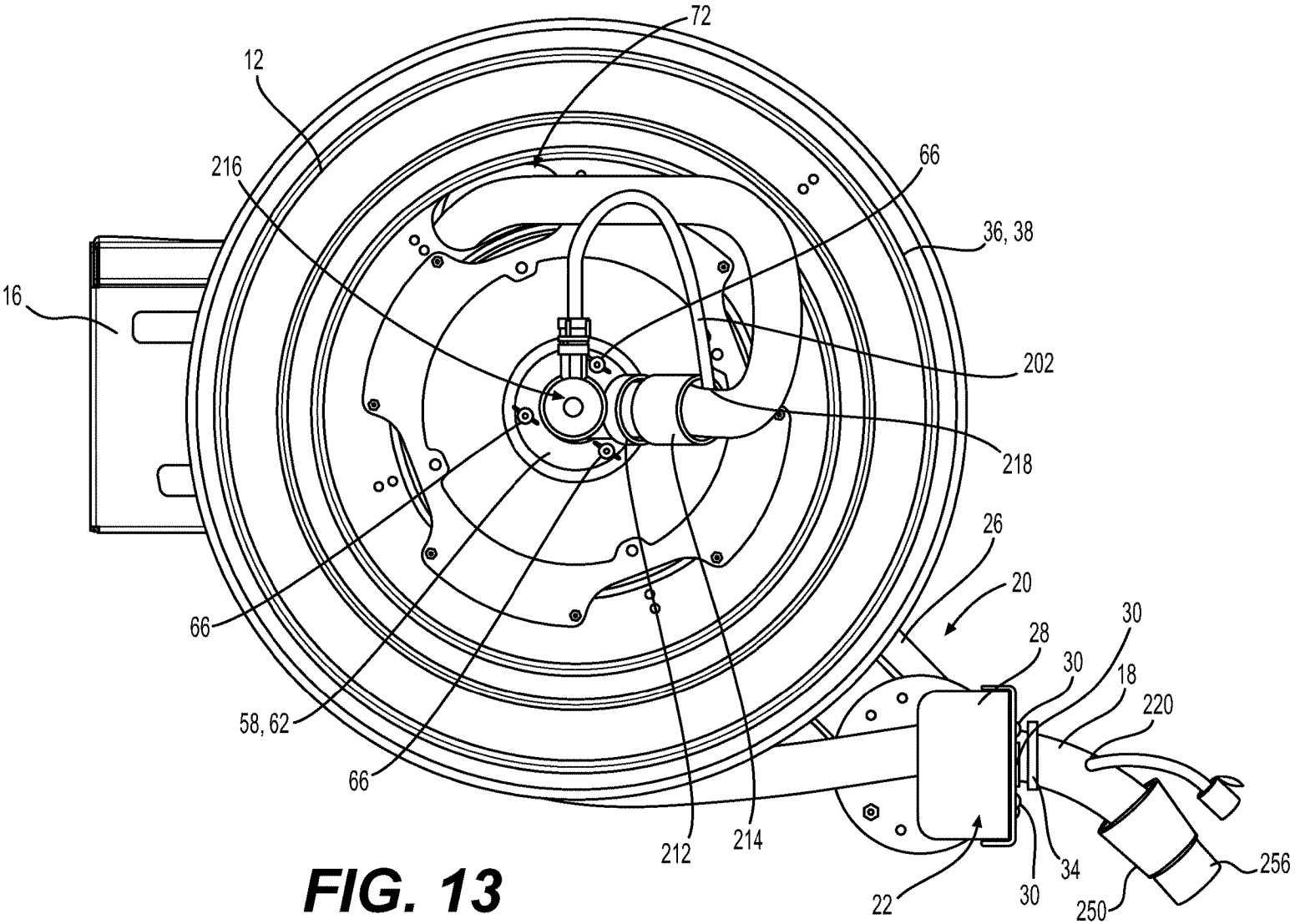
FIG. 13 is a right side elevation view of the retractable vacuum hose reel assembly of FIG. 12.
Figure 14:
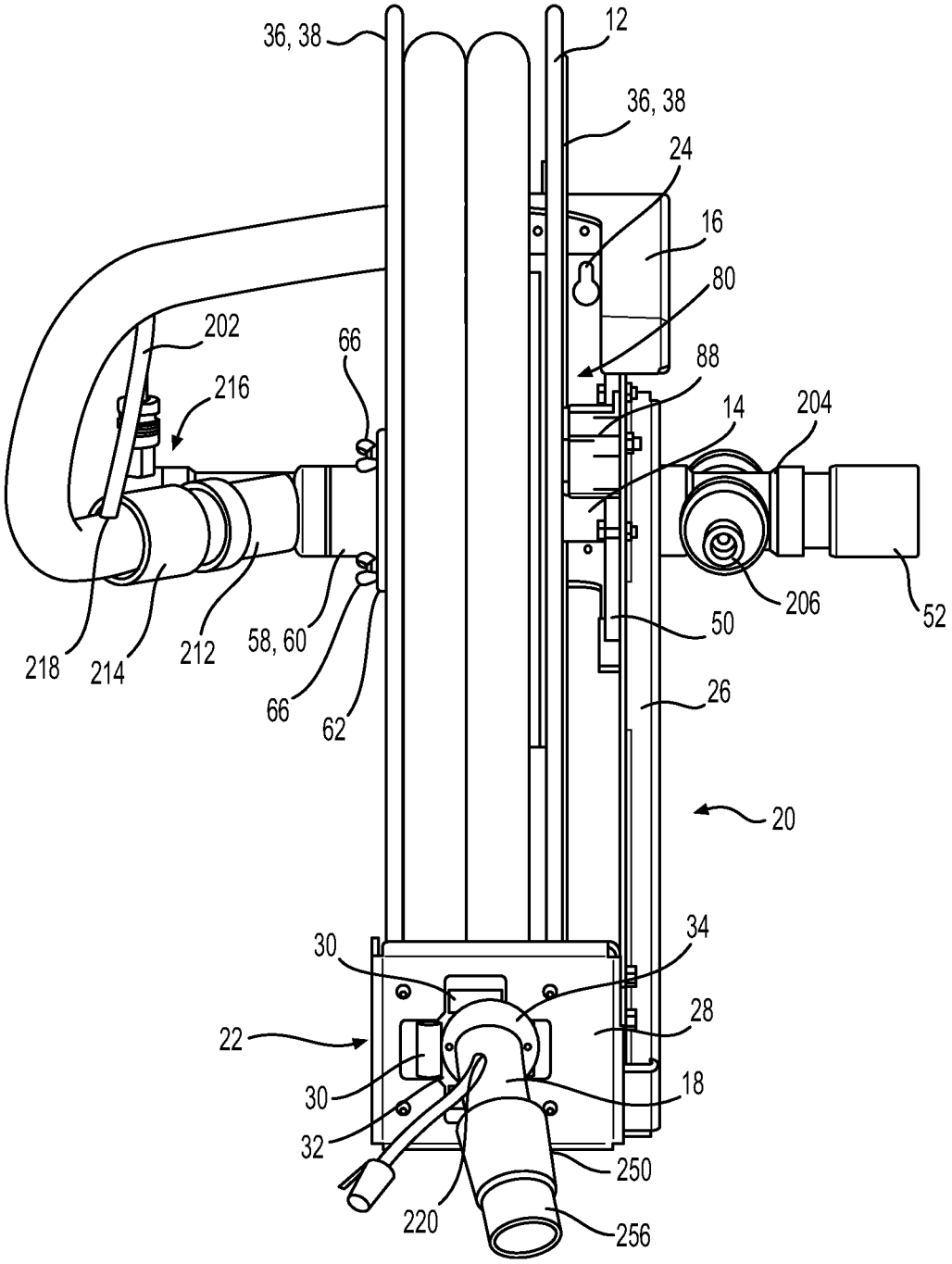
FIG. 14 is a front elevation view of the retractable vacuum hose reel assembly of FIG. 12.
Figure 15:
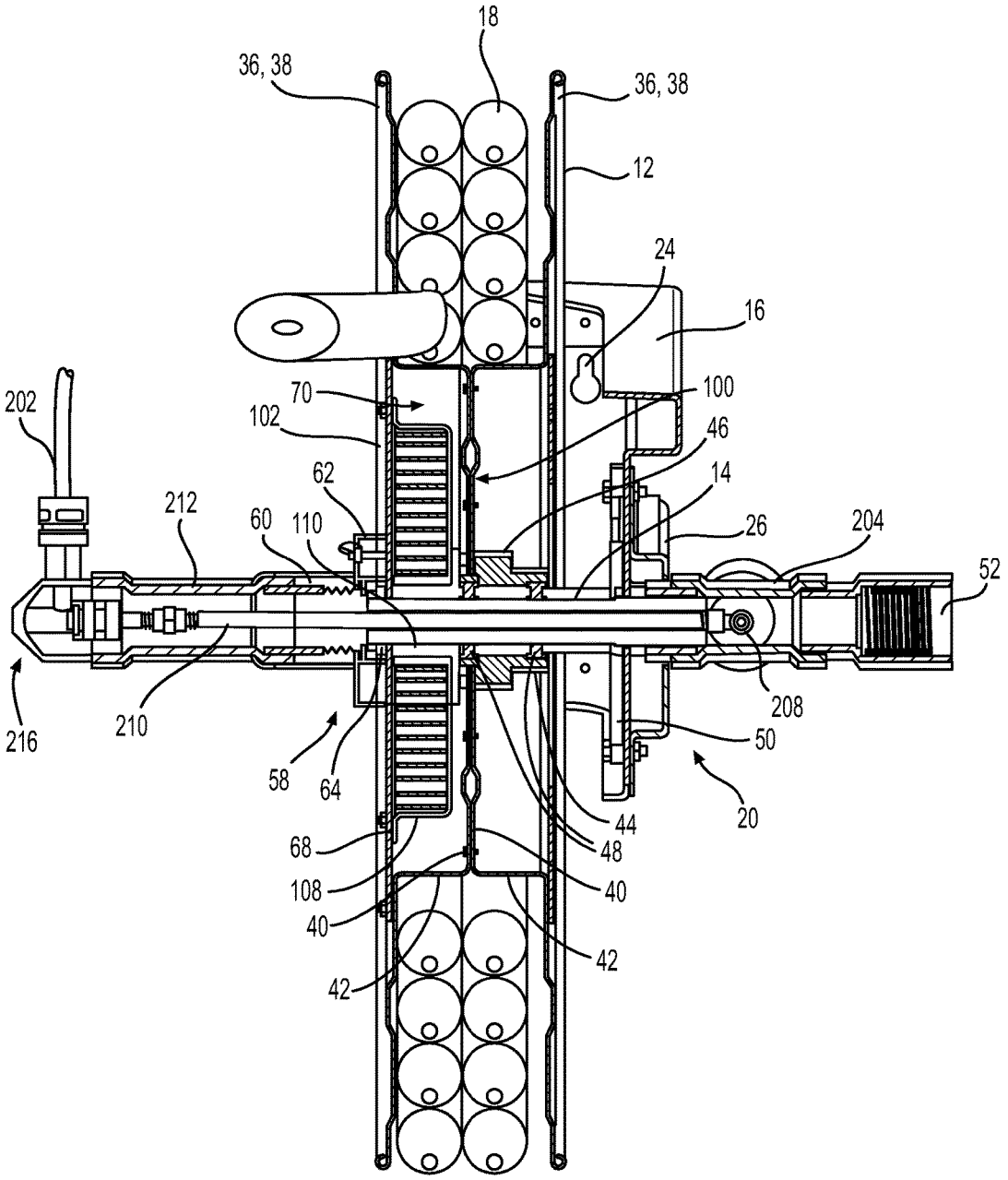
FIG. 15 is a cross-sectional view of the retractable vacuum hose reel assembly of FIG. 12.

An adaptor 204 is connected between the left end of the axle 14 and the vacuum hose connector 52. A fluid hose connector 206 is connected to the adaptor 204. The fluid hose connector 206 connects via a fluid hose (not shown) to the fluid source. The fluid source can be a source of pressurized or unpressurized water or a source of pressurized air depending on the type of fluid hose 202 being used. The fluid hose connector 206 connects to an elbow fitting 208 (FIG. 15) located inside the adaptor 204. From the elbow fitting 208, a fluid hose 210 extends inside the axle 14 as can be seen in FIG. 15. As can be seen in FIGS. 13 and 14, a dual branch adaptor 212 is connected to the seal assembly 58 so as to turn with the seal assembly 58 and the reel 12. A vacuum hose connector 214 is connected to the branch of the dual branch adaptor 212 that is angled relative to the axle 14. The vacuum hose connector 214 is similar to the vacuum hose connector 52 and will therefore not be described in detail herein. The end of the vacuum hose 18 is connected to the vacuum hose connector 214. A rotating fluid connector assembly 216 is connected to the end of the branch of the dual branch adaptor 212 that is coaxial with the axle 14. The fluid hose 210 connects to one end of the rotating fluid connector assembly 216. The fluid hose 202 connects to the other end of the rotating fluid connector assembly 216. As the reel 12 turns, the end of the rotating fluid connector assembly 216 to which the fluid hose 202 is connected turns with the reel 12, while the end of the rotating fluid connector assembly 216 to which the fluid hose 210 is connected remains rotationally fixed, thus preventing the fluid hose 210 from twisting when the reel 12 turns. From the rotating fluid connector assembly 216, the fluid hose 202 enters the vacuum hose through an aperture 218 near the end of the vacuum hose 18 connected to the vacuum hose connector 214, then extends inside the vacuum hose 18, and exits the vacuum hose 18 through an aperture 220 near the opposite end of the vacuum hose 18.

Figure 16:
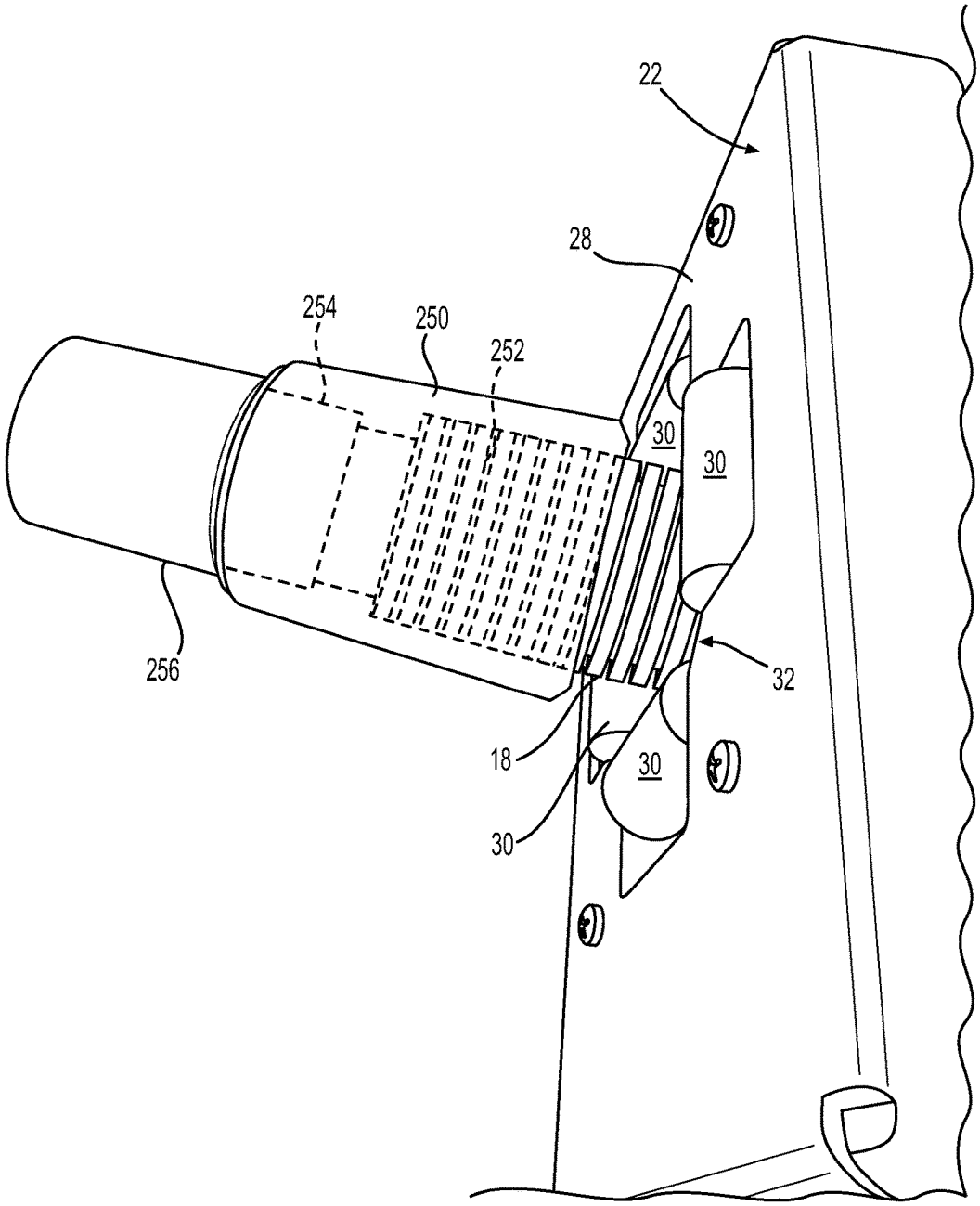
FIG. 16 is a top, front, left side perspective view illustrating a hose stopper accessory connected to an end of the vacuum hose of the retractable vacuum hose reel assembly of FIG. 12.

A hose stopper 250 is connected to the end of the vacuum hose 18. The hose stopper 250 is provided in addition to the stopper clip 34. In the event that the stopper clip 34 accidentally comes off the vacuum hose 18, or if the user simply forgot to attach the stopper clip to the vacuum hose 18, the hose stopper 250 will prevent the vacuum hose 18 from going completely through the guide passage 32. As best seen in FIG. 16, the hose stopper 250 of the present implementation is frustoconical in shape. One side of the hose stopper 250 defines internal threads 252 (schematically illustrated) to thread the hose stopper 250 onto the end of the vacuum hose 18. The other side of the hose stopper defines a bore 254 to receive a vacuum accessory connector 256 therein. The vacuum accessory connector 256 is held by friction fit inside the bore 254, but other types of connections are contemplated. The vacuum accessory connector 256 permits the attachment of various vacuum accessories to the end of the vacuum hose 18. The largest diameter of the hose stopper 250 is greater than the size of the guide passage 32. As such, should the stopper clip 34 be missing, as the vacuum hose 18 is wound on the reel 12, the hose stopper 250 will eventually come into contact with the rollers 30, thereby preventing the vacuum hose 18 from passing completely through the guide passage 32. It is contemplated that the hose stopper 250 could have other shapes as long as it is dimensioned so as to not pass through the guide passage 32. It is contemplated that the hose stopper 250 could also be connected to the end of the vacuum hose 18 of the vacuum hose reel assembly 10.

It is contemplated that the vacuum hose reel assemblies 10 and 200 described above could be provided without the hoses 18, 202 and the user could then connect suitable hoses 18, 202 of his or her choosing to the vacuum hose reel assemblies 10, 200. It is also contemplated that the vacuum hose reel assemblies 10 and 200 could be mirror images from the way they are illustrated in the Figures.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A vacuum hose reel assembly comprising:

a rotationally fixed axle;

a reel rotationally mounted to the axle; and a spring assembly operatively connected between the axle and the reel, the spring assembly being adapted for turning the reel in order to wind a vacuum hose on the reel, the spring assembly comprising:

a spring holder connected to and being rotationally fixed relative to the axle, the spring holder having first and second walls, the first and second walls defining a slot therebetween, the first wall extending radially further from a center of the axle than the second wall, the spring holder having an outer surface extending from a radially outer end of the first wall to a radially outer end of the second wall; and a spiral torsion spring having:

an outer end portion operatively engaging the reel; and an inner end portion selectively operatively engaging the spring holder, the inner end portion being selectively received in the slot of the spring holder;

when the reel is turning in a first direction to unwind the vacuum hose from the reel, the inner end portion of the spiral torsion spring is disposed in the slot and abuts the first wall, and the spiral torsion spring is wound, when the spiral torsion spring turns the reel in a second direction, opposite the first direction, to wind the vacuum hose on the reel, the inner end portion of the spiral torsion spring is disposed in the slot and abuts the second wall, and the spiral torsion spring unwinds, and when a force between the inner end portion of the spiral torsion spring and the second wall exceeds a predetermined force while the reel turns in the second direction, the inner end portion of the spiral torsion spring disengages the spring holder by coming out of the slot and then turning about the spring holder, the inner end portion of the spiral torsion spring abutting the outer surface of the spring holder as the inner end portion turns, for at least a portion of a rotation.

2. The vacuum hose reel assembly of claim 1, wherein the outer surface of the spring holder has a shape of a segment of a spiral.

3. The vacuum hose reel assembly of claim 1, wherein:

a radially inner end of the first wall of the spring holder is radially spaced from the axle;

the spring holder has an inner surface extending from the radially inner end of the first wall away from the second wall, the inner surface being radially spaced from the axle;

the inner surface of the spring holder and the axle define a space radially therebetween, the space communicates with the slot; and when the inner end portion of the spiral torsion spring is disposed in the slot, the inner end portion of the spiral torsion spring is disposed in the space.

4. The vacuum hose reel assembly of claim 3, wherein the inner end portion of the spiral torsion spring is hook-shaped.

5. The vacuum hose reel assembly of claim 3, wherein the radially inner end of the first wall is radially further from the center of the axle than the radially outer end of the second wall.

6. The vacuum hose reel assembly of claim 1, wherein:

a side of the reel defines a recess; and the spring assembly is disposed in the recess.

7. The vacuum hose reel assembly of claim 6, wherein:

the spring assembly has a spring housing;

the spiral torsion spring is disposed in the spring housing;

the spring housing has an eccentric contour; and the outer end portion of the spiral torsion spring is disposed in a portion of the spring housing defined by a portion of the eccentric contour being furthest from a central axis of the reel.

8. The vacuum hose reel assembly of claim 1, further comprising a ratchet assembly operatively connected to the reel and selectively preventing turning of the reel to wind the vacuum hose.

9. The vacuum hose reel assembly of claim 8, wherein the ratchet assembly and the spring assembly are disposed on opposite sides of the reel.

10. The vacuum hose reel assembly of claim 8, wherein:

the ratchet assembly comprises a plate connected to a side of the reel;

the plate defines a central aperture; and the plate defines internal ratchet teeth over only a portion of a contour of the central aperture.

11. The vacuum hose reel assembly of claim 1, wherein:

the axle is hollow;

a first end of the axle is adapted for fluidly communicating with a vacuum cleaner; and a second end of the axle is adapted for fluidly communicating with the vacuum hose.

12. The vacuum hose reel assembly of claim 11, further comprising the vacuum hose fluidly connected to the second end of the axle.

13. The vacuum hose reel assembly of claim 12, wherein the vacuum hose extends from the second end of the axle outside the reel, extends through a side of the reel, and is selectively wound about the reel.

14. The vacuum hose reel assembly of claim 13, further comprising a seal assembly disposed over the second end of the axle; and wherein the vacuum hose is connected to the seal assembly.

15. The vacuum hose reel assembly of claim 14, wherein the seal assembly is connected to and turns with the reel.

16. The vacuum hose reel assembly of claim 12, further comprising at least one fluid hose extending inside the axle and at least partially inside the vacuum hose.

17. The vacuum hose reel assembly of claim 16, wherein the at least one fluid hose is one of at least one water hose and at least one pressurized air hose.

18. The vacuum hose reel assembly of claim 12, further comprising:

a guide assembly connected to the axle, the guide assembly defining a guide passage; and a hose stopper connected to an end of the vacuum hose; wherein:

the vacuum hose extends through the guide passage; and the hose stopper is dimensioned so as to not pass through the guide passage.

19. The vacuum hose reel assembly of claim 1, further comprising:

a mounting bracket connected to the axle;

a guide assembly connected to the mounting bracket in at least one of a first configuration and a second configuration, the guide assembly including a guide adapted to receive the vacuum hose extending from the reel therethrough, in the first configuration the guide guiding the vacuum hose generally horizontally, in the second configuration the guide guiding the vacuum hose generally vertically.

20. The vacuum hose reel assembly of claim 1, further comprising at least one ball bearing disposed between the axle and the reel for rotationally supporting the reel about the axle.

21. The vacuum hose reel assembly of claim 20, wherein the at least one ball bearing is two ball bearings.

* * * * *